US005921086A

United States Patent [19]

Cheng

[11] Patent Number: 5,921,086

[45] Date of Patent: Jul. 13, 1999

[54] COOLING TYPE COLD WIND FAN ASSEMBLY

[76] Inventor: Ting Kwok Cheng, No.131, Min Sheng St., Fu Kang Yangmei Cheng, Taoyuan Hsien, Taiwan

[21] Appl. No.: 08/805,305

[22] Filed: Feb. 25, 1997

[30] Foreign Application Priority Data

Mar. 1, 1996 [CN] China ..... 96 2 29380.6

[51] Int. Cl.[6] ..... F25B 21/02

[52] U.S. Cl. ..... 62/3.2; 62/435

[58] Field of Search ..... 62/3.2, 3.7, 430, 62/434, 435, 411, 419, 426

[56] References Cited

U.S. PATENT DOCUMENTS 3,205,667 9/1965 Frantti ..... 62/3.7
5,131,236 7/1992 Wruck et al. ..... 62/209
5,544,487 8/1996 Attey et al. ..... 62/3.7
5,544,489 8/1996 Moren ..... 62/3.7

*Primary Examiner*—William Doerrler
*Attorney, Agent, or Firm*—Dougherty & Troxell

[57] ABSTRACT

A cooling type cold wind fan assembly including a coolant reservoir containing a coolant, a cooling cylinder being disposed in the coolant reservoir, a top end of the cooling cylinder being attached to the cold interface of a cooling chip, and a heat-radiating fan being disposed above the hot interface of the cooling chip. A cooling circuit has one end connected under the coolant reservoir, and includes a solenoid and a circulation pump disposed near the end of the cooling circuit. A heat-absorbing winding tube is disposed behind the circulation pump, the rear end of the heat-absorbing winding tube being connected back to the coolant reservoir via a returning tube. A blowing fan is disposed in front of the heat-absorbing winding tube with an activated carbon filter mesh disposed in front of the blowing fan.

5 Claims, 3 Drawing Sheets

COOLING TYPE COLD WIND FAN ASSEMBLY

BACKGROUND OF THE INVENTION

The present invention relates to a cooling type cold wind fan assembly in which a cooling cylinder is disposed in the coolant reservoir with one end directly attaching to the cold interface of a cooling chip for directly decreasing the temperature of the coolant. A circulation pump is used to suck the cooled coolant into an evaporator for absorbing heat so as to decrease the temperature of the ambient air. A blowing fan serves to blow out the cold air to create cold wind.

The cooling mechanism of a conventional air-conditioner employs a compressor to compress a Cooling medium into a high pressure state. Thereafter the cooling medium flows to a condenser for dissipating the heat absorbed by the cooling medium and a heat-radiating fan is used to exhaust the heat of the condenser. Then the cooling medium flows through a cooling medium tube into the evaporating winding tube of the evaporator. The high pressure cooling medium expands and absorbs heat in the winding tube so as to abruptly coot the ambient air around the winding tube. A fan then blows out the cold air. The expanding cooling medium then flows through the winding tube back to the compressor to form a circulation. According to the above arrangement, several shortcomings exist as follows:

1. The compressor has quite low efficiency. In general, over one half of the energy of the compressor is wasted. Therefore, with the compressor as a device for decreasing the temperature, a great amount of energy is ineconomically consumed.

2. The cooling medium circulated in the pipe line of the compressor will gradually leak outside after a period of use. The insufficient cooling medium will lead to poor cooling effect. Moreover, the leaking cooling medium will contaminate the environment.

3. The compressor assembly is manufactured with large volume at high cost.

With respect to the cooling mechanism of a conventional cold wind fan, a receptacle is disposed inside the fan for containing ice water. The stored water is transferred by a transferring means to a front side of the fan, whereby the fan blows out the air entraining the water to contact with the skin of the user for absorbing heat and thus creating a cooling effect. However, in use, such device still has the following shortcomings:

1. A great amount of water is entrained in the air blown out of the cold wind fan so that after a period of use, the health of the user will be badly affected (such as rheumatism). Also, this is destructive to the environment (such as humidity and moldering).

2. The water contained in the water receptacle of the cold wind fan must be sprayed out in a foggy state. Therefore, the water receptacle is formed with an opening for balancing the pressure. Due to the opening, in case the cold wind fan is tilted flown, the water in the receptacle will flow out to cause danger such as leakage of electricity.

SUMMARY OF THE INVENTION

It is a primary object of the present invention to provide a cooling type cold wind fan assembly in which a cooling cylinder is disposed in a coolant reservoir with its top end attaching to the cold interface of a cooling chip for absorbing the heat of the coolant through the cooling cylinder. A circulation pump is used to pump the cooled coolant into a cooling circuit for absorbing heat so as to decrease the temperature of the ambient air. A blowing fan serves to blow out the cold air to create cold wind. No compressor or cooling medium is used in the above cold wind fan assembly so that no contamination the environment or waste of energy is incurred.

It is a further object of the present invention to provide the above cold wind fan assembly in which the coolant is totally sealed and contained in the coolant reservoir so that in case the cold wind fan is tilted down, the coolant will not leak outside to contact electrical components or contaminate the environment.

It is still a further object of the present invention to provide the above cold wind fan assembly in which no water is additionally entrained in the cold air so that the cold air is harmless to the human body and the environment.

It is still a further object of the present invention to provide the above cold wind fan assembly in which a certain amount of coolant is contained in the coolant reservoir and previously cooled by a smooth and power-saving speed. When the cold wind fan is operated, the coolant is able to quickly provide cooling effect.

The present invention can be best understood through the following description and accompanying drawings, wherein:

BRIEF DESCRIPTION OF THE DRAWINGS

FIG. 5 is a sectional view showing still another embodiment of the present invention.

DETAILED DESCRIPTION OF THE PREFERRED EMBODIMENT

Figure 1:
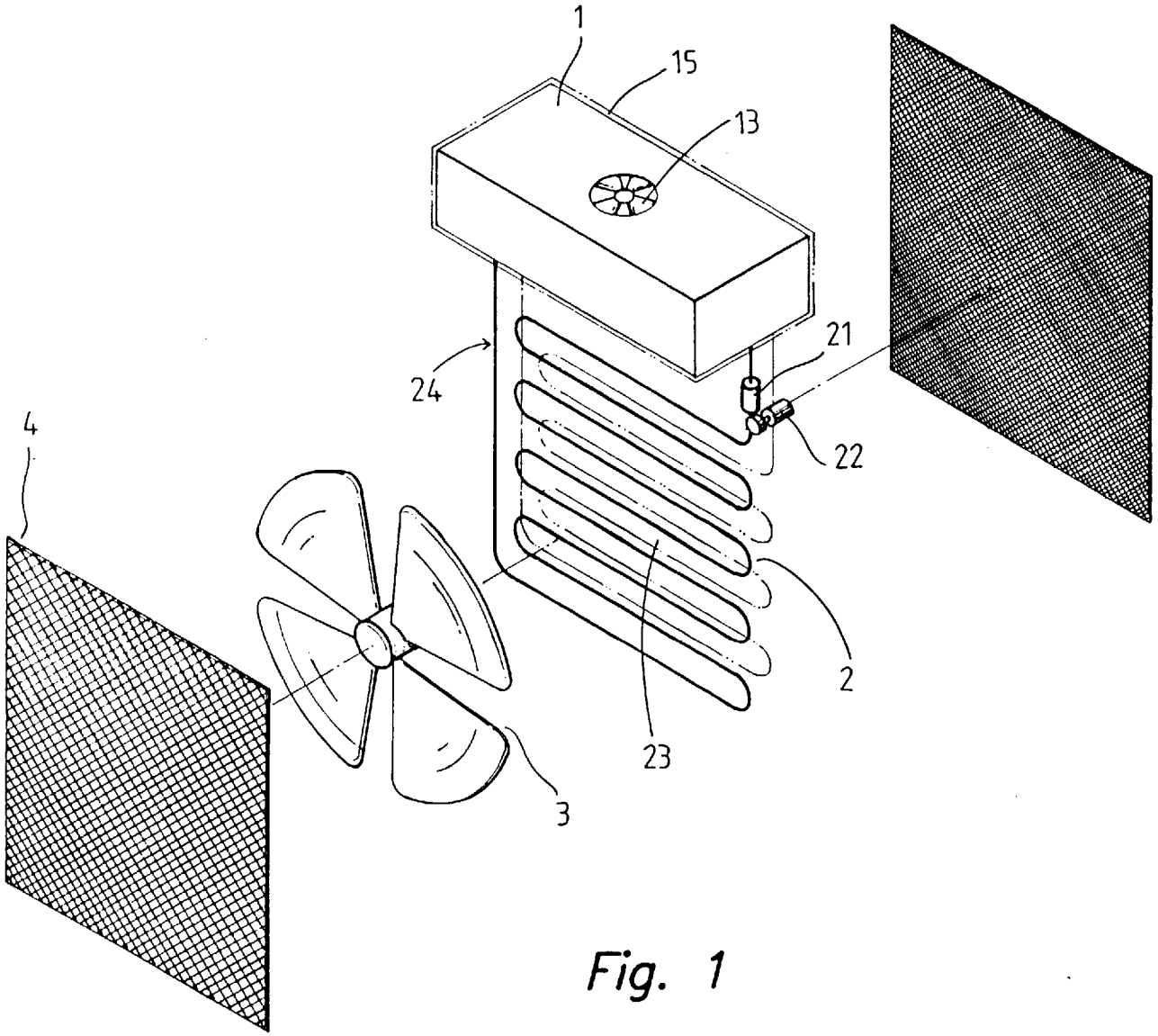
FIG. 1 is a perspective exploded view of the present invention.
Figure 2:
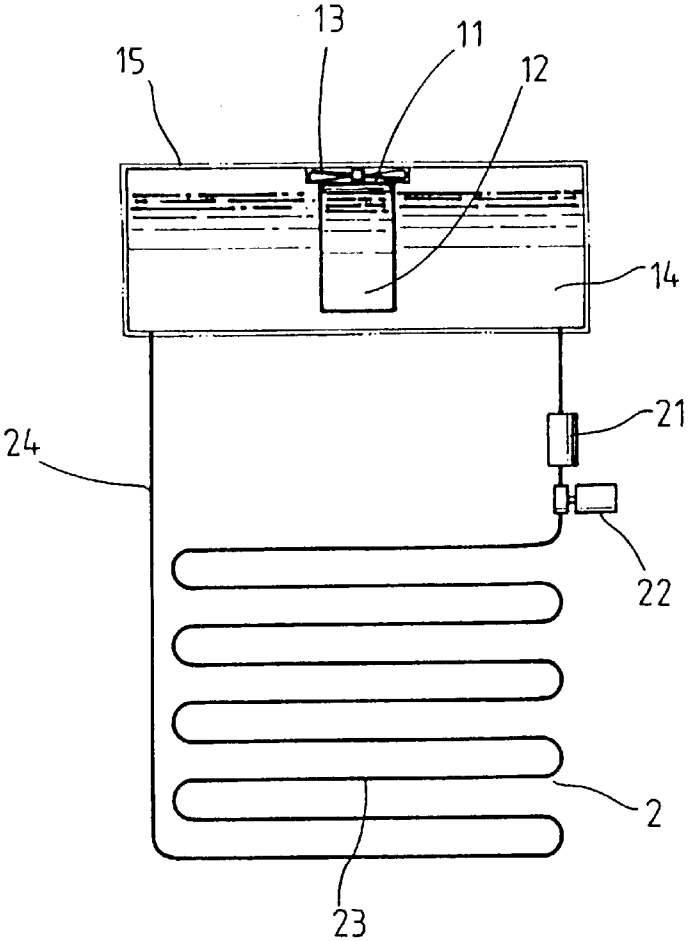
FIG. 2 is a sectional view showing the structure of the present invention.

Please refer to FIGS. 1 and 2. The present invention includes a coolant reservoir 1, a cooling circuit 2, a blowing fan 3 and an activated carbon filter mesh 4. The coolant reservoir 1 contains a coolant 14 and is coated with a heat-insulative layer 15. A cooling cylinder 12 is disposed in the coolant 14 with one end extending beyond the coolant 14 to attach to a cold interface of a cooling chip 11. A heat-radiating fan 13 is disposed above the hot interface of the other end of the cooling chip 11. One end of the cooling circuit 2 is connected under the coolant reservoir 1 via a solenoid 21. A circulation pump 22 is disposed behind the solenoid 21. A heat-absorbing winding tube 23 is connected behind the circulation pump 22. The rear end of the heat-absorbing winding tube 23 is connected back to the coolant reservoir 1 via a returning tube 24. The blowing fan 3 is disposed in front of or behind the heat-absorbing winding tube 23. The filter mesh 4 is disposed in front of the cooling circuit 2 and the blowing fan 3.

Figure 3:
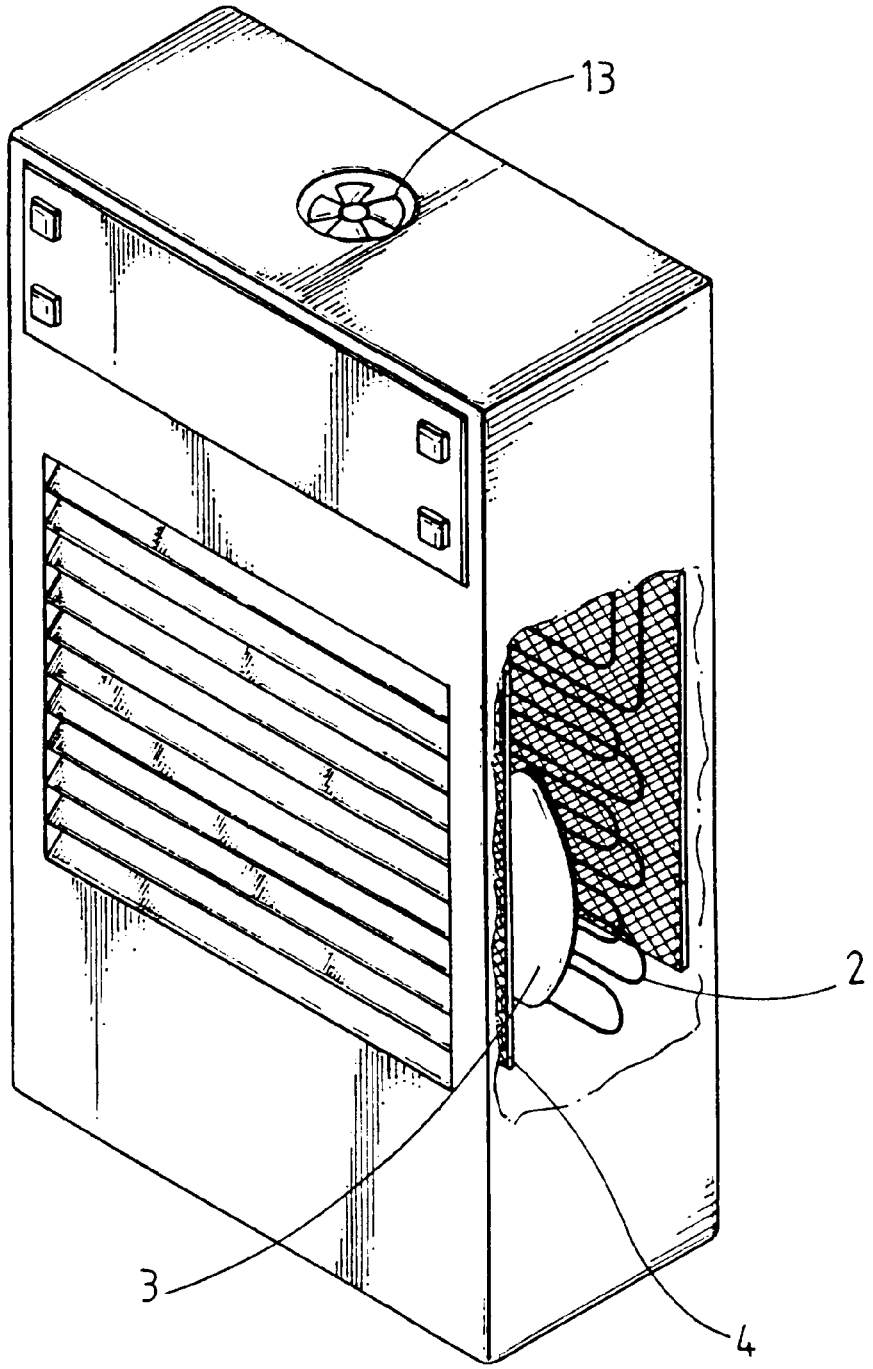
FIG. 3 is a perspective assembled view of the present invention.

Referring to FIG. 3, after the cooling chip 11 is powered on, the temperature of the cold interface is decreased and the cooling cylinder 12 absorbs the heat of the coolant 14, whereby a great amount of cold energy is conserved in the coolant. After the temperature is decreased, the cooled coolant 14 is pumped by the circulation pump 22 to the heat-absorbing winding tube 23 of the cooling circuit 2 for absorbing the heat, whereby the temperature of the ambient air around the winding tube 23 is decreased. After absorbing the heat, the coolant 14 with normal temperature flows back to the coolant reservoir 1 through the circulation tube 24. The blowing fan 3 serves to suck the air through the filter mesh 4 to be filtered thereby. Then the air passes through the cooling circuit 2 to blow out the cold air within the winding tube 23 so as to create cold wind.

Figure 4:
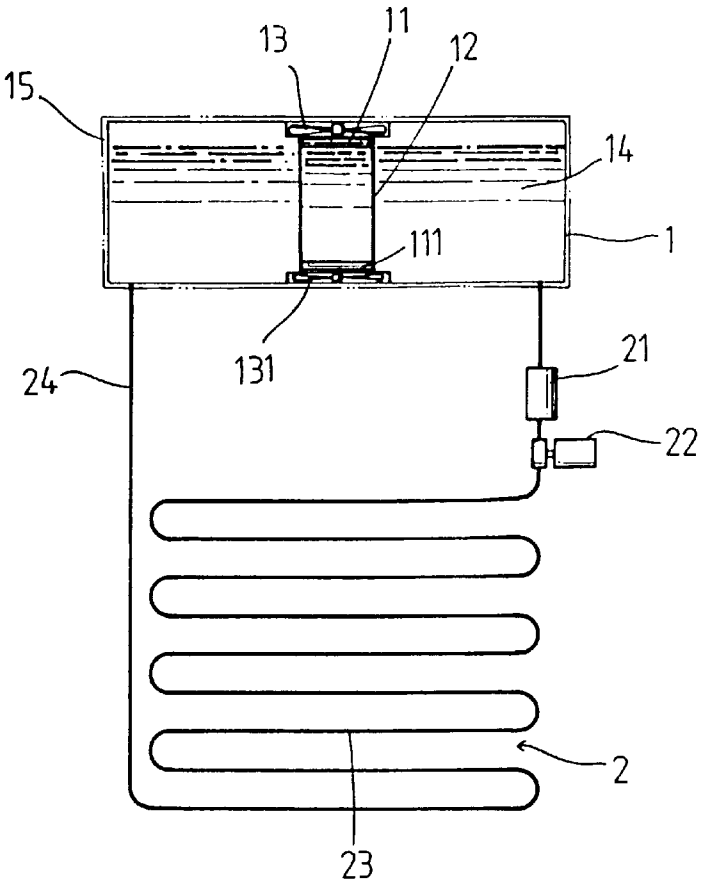
FIG. 4 is a sectional view showing another embodiment of the present invention.

FIG. 4 shows another embodiment of the present invention in which the other end of the cooling cylinder 12 extends below the other side of the coolant reservoir 1 to attach to a cold interface of another cooling chip 111, whereby the two cooling chips 11, 111 cooperate with each other to enhance the temperature decreasing efficiency. Another heat-radiating fan 131 is disposed under the cooling chip 111 to achieve better heat radiating effect.

In addition, the solenoid 21 disposed between the cooling circuit 2 and the circulation plump 22 serves to control whether the coolant 14 flows into the cooling circuit 2, whereby in the case that the coolant 14 does not flow into the cooling circuit 2, the present invention serves as a general fan with wind blowing effect. Therefore, the application range of the present invention is widened. Moreover, after the coolant is fed in, the coolant is delayed for a certain period, whereby the coolant flowing into the cooling circuit can fully absorb the heat and then flow back to the coolant reservoir so as to increase the unit cooling efficiency. The operation of the solenoid 21 and the circulation pump 22 can be controlled by a thermo-controlling switch installed in the coolant reservoir 1, whereby when the temperature of the coolant is increased to a set value, the circulation of the coolant is stopped. After the temperature of the coolant is again decreased, the circulation of the coolant is re-started.

FIG. 5 shows still another embodiment of the present invention, in which a conducting section 16 is additionally disposed. One side of the conducting section 16 attaches to the cold interface of the cooling chip 11, while the hot interface of the cooling chip 11 attaches to a heat-radiating plate 18. The center of the other side of the conducting section 16 is engaged with a cooling bar 17. The cooling bar 17 extends into a cooling cylinder 12 containing the coolant 14. The heat-absorbing winding tube 23 of the evaporator 2 is wound around the outer circumference of the cooling cylinder 12. The winding tube 23 contains a coolant therein. The coolant reservoir 1 is fitted around the winding tube (without containing the coolant ) so as to avoid loss of energy. Accordingly, after the winding tube 23 absorbs the heat of the ambient air to decrease the temperature thereof, the coolant in the winding tube 23 is restored to normal temperature. At this time, by means of the conduction of the conducting section 16, the temperature of the cooling bar 17 is decreased along with the cold interface of the cooling chip 11. Also, the coolant 14 in the cooling cylinder 12 is cooled to a predetermined value for conservation of cold energy. When the temperature of the cooling cylinder 12 is decreased due to the cooling of the coolant 14, the temperature of the coolant in the winding tube 23 is decreased to create cold wind. In addition, a thermosensing rod 19 is disposed at the end of the winding tube 23 for detecting whether the temperature of the coolant 14 is too low so as to automatically cut off the power for the cooling chip 11.

It should be noted that the above description and accompanying drawings are only used to illustrate some embodiments of the present invention, not intended to limit the scope thereof. Any modification of the embodiments should fall within the scope of the present invention.

What is claimed is:

1. A cooling type cold wind fan assembly comprising a coolant reservoir, a cooling circuit, a blowing fan and an activated carbon filter mesh, wherein the coolant reservoir contains a coolant and the cooling circuit is connected under the coolant reservoir, and further comprising a circulation pump disposed in the cooling circuit so as to pump the coolant through the cooling circuit for absorbing heat, the blowing fan being disposed so as to force air over the cooling circuit; a cooling cylinder disposed in the coolant reservoir with at least one end extending beyond the coolant and attached to a cold interface of a cooling chip; a solenoid located in the cooling circuit for controlling coolant flow through the cooling circuit, wherein the circulation pump and the solenoid are connected to a thermo-controlling switch in the coolant reservoir, whereby the thermo-controlling switch detects the temperature of the coolant and controls the operation of the circulation pump and solenoid.

2. A cold wind fan assembly as claim in claim 1, wherein opposite ends of the cooling cylinder respectively extend above and below the coolant reservoir and each end is attached to a cold interface of a cooling chip.

3. A cold wind fan assembly as claimed in claim 1, wherein the blowing fan is disposed between the filter mesh and the cooling circuit.

4. A cold wind fan assembly as claimed in claim 2, wherein the blowing fan is disposed between the filter mesh and the cooling circuit.

5. A cooling type cold wind fan assembly comprising a coolant reservoir and a cooling circuit wherein the coolant reservoir contains a coolant and the cooling circuit is connected to the coolant reservoir, and further comprising a cooling cylinder extending through an interior of the coolant reservoir, at least one end of the cooling cylinder attached to a cold interface of a cooling chip disposed on the coolant reservoir; a solenoid located in the cooling circuit for controlling coolant flow through the cooling circuit; and a thermo-controlling switch in the coolant reservoir and connected to the solenoid whereby the thermo-controlling switch detects the temperature of the coolant and controls the operation of the solenoid.

* * * * *